United States Patent [19]

Dunn

[11] Patent Number: 4,987,715

[45] Date of Patent: Jan. 29, 1991

[54] PARALLEL BEAM SYSTEM

[75] Inventor: James J. Dunn, Charles, Ill.

[73] Assignee: Chicago Metallic Corporation, Chicago, Ill.

[21] Appl. No.: 846,004

[22] Filed: Mar. 31, 1986

[51] Int. Cl.[5] ..... E06B 7/08

[52] U.S. Cl. ..... 52/489; 52/473; 52/762

[58] Field of Search ..... 52/778, 489, 717.1, 52/484, 762, 311, 473

[56] References Cited

U.S. PATENT DOCUMENTS

| | | | |
|---|---|---|---|
| 2,803,858 | 8/1957 | Rader | 52/489 |
| 3,226,898 | 1/1966 | Blok . | |
| 3,277,622 | 10/1966 | Jensen . | |
| 3,295,284 | 1/1967 | Tschiesche . | |
| 3,313,075 | 4/1967 | Buchmeier . | |
| 3,336,705 | 8/1967 | Vecchiarelli et al. . | |
| 3,374,590 | 3/1968 | Kessler | 52/717.1 |
| 3,410,043 | 11/1968 | Rijnders | 52/460 |
| 3,548,556 | 12/1970 | Vermeulen . | |
| 3,548,557 | 12/1970 | Downing, Jr. | 52/762 |
| 3,645,051 | 2/1972 | Kolesar . | |
| 3,678,641 | 7/1972 | Englund et al. . | |
| 3,831,506 | 8/1974 | Landheer . | |
| 3,832,820 | 9/1974 | Eggert | 52/762 |
| 4,245,446 | 1/1981 | Judkins . | |
| 4,257,206 | 3/1981 | Mieyal . | |
| 4,270,327 | 6/1981 | Van Leeuwen . | |
| 4,272,937 | 6/1981 | Brugman . | |
| 4,308,706 | 1/1982 | Rijnders . | |
| 4,328,653 | 5/1982 | Anderle . | |
| 4,361,996 | 12/1982 | Smith . | |
| 4,448,006 | 5/1984 | Worley . | |
| 4,580,382 | 4/1986 | Judkins et al. | 52/489 |

OTHER PUBLICATIONS

Sales Brochure "Vista Ceiling Systems" Chicago Metallic Corporation, 1982, pp. 1–5 and the back cover.

Sales sheets entitled "2B, Paraline II TM Ceiling System"; 2C. Paralock TM Suspension System and 2D, Symmetrical Carrier Donn Corporation 1979.

*Primary Examiner*—Henry E. Raduazo

*Attorney, Agent, or Firm*—Hill, Van Santen, Steadman & Simpson

[57] ABSTRACT

A system for forming either horizontal or vertical walls characterized by a plurality of beam elements, an arrangement for holding the beam elements to extend parallel to each other with a desired spacing between adjacent beam elements and a filler strip or element inserted between adjacent beam elements. The filler strips have a U-shaped configuration with a crease forming a catch surface for engaging an external shoulder on an edge of each of the beam elements to hold the filler strip with the edge of the leg of the filler strip engaged on a flange of the leg of the beam element. Thus, the mounting of the filler strip is the same regardless of the height of the element relative to the face portions of each of the beam elements. The beam elements can have a flat face portion or be provided with a longitudinally extending depression to subdivide the face portion into two parallel extending subportions.

8 Claims, 1 Drawing Sheet

PARALLEL BEAM SYSTEM

BACKGROUND OF THE INVENTION

The present invention is directed to a system for covering a surface such as a ceiling or suspended ceiling, and the system can also be used for covering a side wall. The system utilizes a plurality of beam elements which are substantially a U-shaped cross-section and a mounting arrangement for mounting the beams to extend parallel to each other with a desired spacing between the beams and filler elements which are inserted in a spacing between the beams with a snap fit.

Ceiling systems having parallel beams are known. Examples of such ceiling systems are disclosed in U.S. Pat. Nos. 3,277,622; 3,313,075 and 4,328,653. These ceiling systems can be used in conjunction with a suspended ceiling consisting of T bars for holding the panels of sound-absorbing material as disclosed in U.S. Pat. Nos. 3,295,284; 4,361,996 and 4,448,006. In addition, the beam elements can be mounted both on curved surfaces and side walls such as illustrated by U.S. Pat. No. 4,270,327.

In many of the above-mentioned systems, there is spacing left between the edges of adjacent beam elements. However, it is known to provide a filler strip or member between the edges as disclosed in U.S. Pat. Nos. 3,410,043 and 3,645,051.

SUMMARY OF THE INVENTION

The object of the present invention is to provide a covering system which can be utilized for covering either ceilings, such as a suspended ceiling, or covering walls. The system provides a filling element having a U shape which can be snapped into the space between adjacent beams and has a catch shoulder formed in its legs to engage an external shoulder of each leg of each beam and a flange in which the legs of each beam terminate to hold the filling element in the desired position. Thus, filling elements which will provide a recess at the joint can be utilized or filling elements which provide a flush appearance with the beams can be utilized. In addition, the system enables utilizing beams which have a greater length along the edges of each of the beams so that the face of the beam can be shaped to provide different architectural features. This enables a greater selection and flexibility in the style of the beam arrangements to achieve different architecturally aesthetic arrangements.

To accomplish these goals, the present invention is directed to a system for covering surfaces to form a selected horizontal and vertical wall surface, said system comprising a plurality of beam elements, each beam element having a main panel or face portion with two sides, a leg portion along each side terminating in a flange extending substantially parallel to the face portion, said face portion and leg portion providing a substantially U-shaped cross-section with the face portion being a bight portion extending between the parallel leg portions, each of the leg portions at a fixed distance from the flange having a pair of longitudinally extending creases to form an internal shoulder facing an inner surface of the panel or face portion and an outer shoulder facing the flange, means for mounting the beam elements to extend parallel with a prescribed spacing between leg portions of adjacent beam elements, said means for mounting including at least two sets of fastening elements with each fastening element having a pair of oppositely facing hooks for engaging the pair of inner internal shoulders of the beam and means spacing the fastening elements of each set with the desired spacing therebetween to obtain the prescribed spacing between the leg portions of adjacent beam elements and a filler element for assembly between each pair of beam elements, each filler element having a U-shaped cross-section with a flat bight portion and a pair of parallel extending legs having edges, each leg having a crease spaced inward from its edge at a distance equal to said fixed distance to form a catch surface so that the filler element is snapped into the space between edge portions of the adjacent beam elements and the catch surfaces engage the external shoulders to hold the filler element in place as the edges engage the flanges.

Each of the filler elements can have various heights for their legs so that the flat bight portion can either be recessed from the plane of the panel or face portions of the adjacent beams or be flush therewith. Each of the beam elements can have narrow flange elements that do not extend substantially beyond the edge of the external shoulders so that an open revealed beam sequence is obtained, which open reveal is covered by the filler elements. It is also possible to have wide flanges on each of the beams which will overlap to form a closed reveal.

In one embodiment of the invention, each of the leg portions of the beam elements has a substantial height between the external shoulder and the panel portion so that the panel portion can have a depression along the center to form a double beam configuration. This enables a greater flexibility in arranging the panel to obtain different appearances for the system.

DESCRIPTION OF THE PREFERRED EMBODIMENTS

Figure 1:
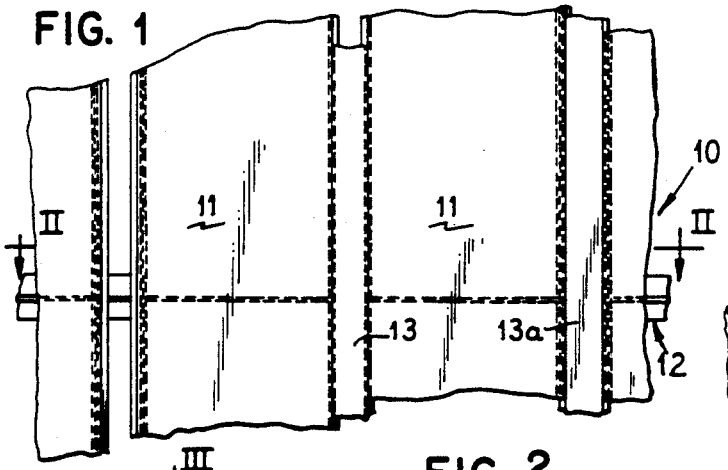
FIG. 1 is a plan view of a portion of the system in accordance with the present invention.
Figure 3:
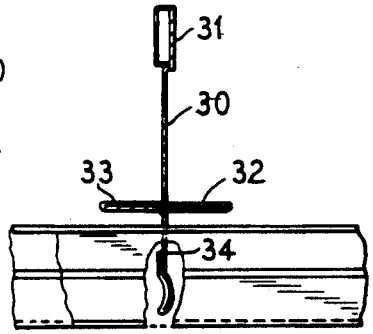
FIG. 3 is a cross-sectional view taken along the lines III—III of FIG. 2 with portions broken away for purposes of illustration.
Figure 2:
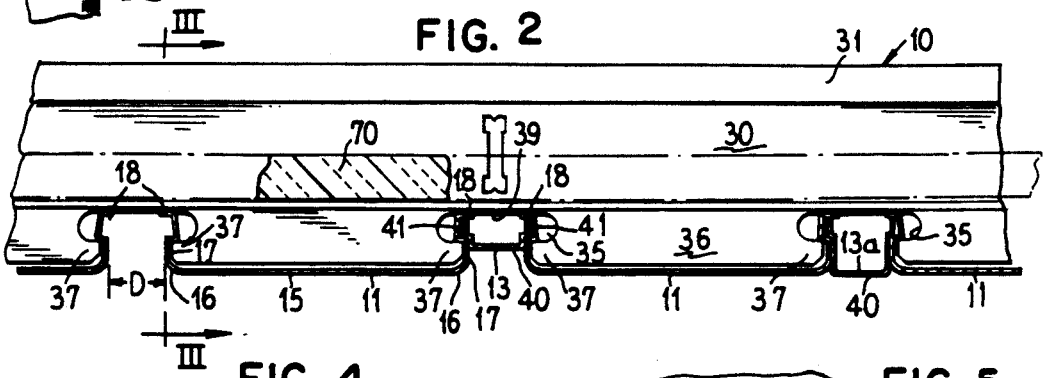
FIG. 2 is an enlarged cross-sectional view taken along lines II—II of FIG. 1.

The principles of the present invention are particularly useful in a system generally indicated at 10 in FIGS. 1 and 2. While the system 10 is illustrated for covering a ceiling or forming a suspended ceiling, it should be noted that the system can be used for vertical walls or even curved surfaces with appropriate modification in the mounting arrangement or means.

Figure 4:
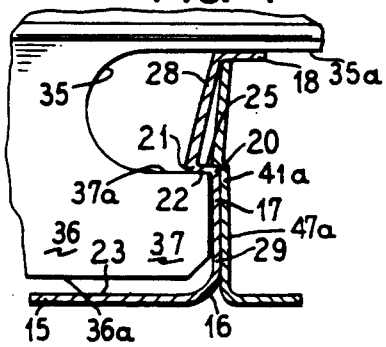
FIG. 4 is an enlarged cross-sectional view of a portion of FIG. 2 showing a filler strip having a flush strip surface.
Figure 5:
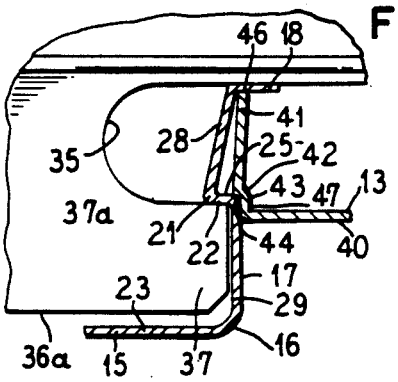
FIG. 5 is an enlarged cross-sectional view similar to FIG. 2 of a filler strip having a recessed surface strip.

As illustrated in FIGS. 1 and 2, the system 10 includes a plurality of beam elements 11, means 12 for mounting the beam elements to extend parallel to one another with a desired spacing therebetween and filler strips 13 and 13*a*. As best illustrated in FIG. 2, each of the beam elements 11 has a face portion or panel portion 15 which terminates on each side in a bend 16 that merges with an integral leg portion 17. Each of the leg portions terminates at the opposite edge in a flange 18 which as illustrated in FIGS. 4 and 5 does not extend substantially beyond the leg portion 17. Each of the leg portions 17 has a pair of longitudinally extending bends 20 and 21 (best illustrated in FIGS. 4 and 5) to form an internal shoulder 22 facing an inner surface 23 of the face portion 15 and also an external shoulder 25 which faces towards the flange 18. The two bends 20 and 21 are positioned to be at a predetermined distance or fixed distance from the flange 18 and the two bends 20 and 21 also subdivide the leg into a portion 28 that extends between the flange 18 and one of the bends 21 and a second portion 29 which extends between the curve or bend 16 and the other longitudinal bend 20. The bends 20 and 21 are such that the surfaces of the shoulders 22 and 23 are substantially parallel to the surface 23 of the face 15.

To mount each of the beam elements 11 to extend parallel with a fixed distance D between leg portions 17 of adjacent beams, the mounting means 12 is utilized. As illustrated, the mounting means 12 includes an inverted T carrier 30 which has a single sheet of metal bent at one end to form a bead 31 and bent at the opposite end to form a pair of flanges 32 and 33 with a depending portion 34. The flanges 32 and 33 can support ceiling panels 70 as illustrated in FIG. 2 and thus produce a continuous ceiling about the plane of the beam elements 11.

The depending portion 34 is best illustrated and FIG. 2 and has a plurality of notches or cutouts 35 which are spaced therealong to form clips 36. The shape of each of the notches 35 forms oppositely facing hook portions 37,37 for each clip 36 which hook portions 37 have surfaces **37*a* to engage the inner shoulders 22 (see FIGS. 4 and 5) as the beam element 11 is snapped into an assembled relationship thereon. The portion 29 of the leg portions 17 is of a width which is slightly greater than the distance between surfce 37*a* and an edge 36*a* so that the inner surface 22 is spaced from edge 36*a*. In the illustrated embodiment, a portion 39 of the dependent web 34 provides means to hold the clips 36 at the desired spacing. While the abovementioned mounting means used a carrier beam 30, it should be noted that the clip elements such as 36 can be formed as separate elements which are clipped onto a flange of a conventional inverted T carrier or can be formed as a plurality of clips having a fastening arrangement for fastening the plurality of clips to one of the flanges of an inverted T carrier. It should be noted that the size of the notch 35 is such that the flange such as 18 can be resting on an edge 35*a* of the notch as the shoulder 22 is engaged by the surface 37*a* of the hook 37. Preferably, the flange 18 will have a slight taper away from the surface 23 to form a spring-like element for biasing the shoulder 22 against the surface 37*a*** of the hook. This will remove possible rattles in the system. If it is desired to not have the flange rest on the notch, then the size of the notch can be changed accordingly.

As mentioned hereinabove, the clips 36 are spaced to provide a fixed spacing D between legs of adjacent panels 11. A filler element such as 13 or **13*a* is inserted in the space with a snap-fit. The filler element 13, as best illustrated in FIGS. 2 and 5, has a flat portion 40 and two leg portions 41 which extend from the flat portion 40 and form a U-shaped cross-section. Each of the legs 41 is a substantially planar, flat portion and is provided with a pair of longitudinally extending bends or creases 42 and 43 (FIG. 5) which form a single, outwardly extending catch shoulder or surface 44 for engaging the external shoulder 25. The position of the bends 42 and 43 are such that an edge 46 of the leg 41 will engage an upper surface of the flange 18 as illustrated in FIG. 5 as the catch surface 44 engages the shoulder 25**.

The filler element 13 provides a recessed surface because the rest of the leg 47 between the bends 42, 43 and the flat portion 40 is very small. In the embodiment of the filler element **13*a*, the leg 41*a* has the bends 42 and 43 but a portion 47*a* is substantially greater than this portion 47 so that the surface 40 lies flush with the faces or panel portions 15 of the adjacent beam elements 11 (see FIG. 4**).

By selecting the type of filler element 13 or **13*a*, different aesthetic structures can be created with the beam elements 11. Because the distance between the edge 46 and surface 44 is always the same, each element 13 or 13*a* will always be mounted with the surface 44 engaged on the shoulder 25 regardless of the size or shape of the portions 47 or 47*a* of the element 13 or 13*a*, respectively. It is possible, as illustrated in FIG. 2**, to use both types of fillers elements in different patterns to obtain differently textured surfaces.

Figure 6:
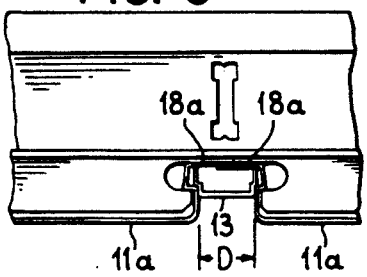
FIG. 6 is a partial cross-sectional view similar to FIG. 2 of another embodiment of the beam elements.

The beam elements 11 have rather narrow flanges 18. However, the beam elements, such as the element **11*a* in FIG. 6, can have a substantially wider flange 18*a* which has a width greater than half of the distance D so that it will overlap with an adjacent flange 18*a* of the adjacent beam. This will form a closed reveal arrangement which does not require any filler bars or elements 13. However, by utilizing the filler bar or element 13, a controlled recess surface can be provided. Also, the color of the bar 13 can be different than that of the beams such as 11*a*** to provide contact and to give a different aesthetic appeal.

Figure 7:
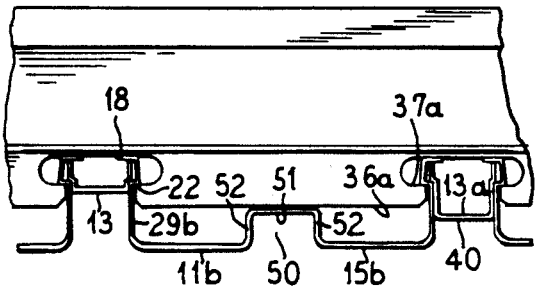
FIG. 7 is a partial cross-sectional view similar to FIG. 2 showing yet another embodiment of a beam element.

Another embodiment of the beam element is illustrated by the beam element **11*b* in FIG. 7. In this embodiment, the beam element has a greater height. It should be noted that the distance of the portion 28 between the flange 18 and the shoulder 22 is the same, however, the portion 29*b* is substantially greater than the portion 29 of the beam element 11 of FIG. 2. This means that the face portion such as 15*b* is spaced from the upper surface 36*a* of the clip 36. It also means that the face portion 15*b* will not lie flush with the flat or planar surface 40 of the filler bar or element 13*a* as illustrated in FIG. 7**.

Another feature of the embodiment of the element **11*b* is that the face portion 15*b* is provided with a center depression 50 to subdivide the face portion 15*b* into two parallel extending portions which extend in the same plane (FIG. 7). As illustrated, the depression 50 has a substantially rectangular cross-section with a base 51 and two side walls 52 connected to the remaining portion of the face portion 15*b*. This provides a different architectural surface for the beam elements which can be used with either the filler elements 13 or 13*a* or combinations thereof. As in previous embodiments, by providing different finishes on the beam element 11*b* from that on the filler bars 13 and 13*a* as well as the surface of the portion 51**, different combinations of colors and/or material finishes can be obtained to produce different aesthetic appeals.

It is also possible to utilize both the beam elements 11 with the beam elements **11*b* and with the different size filler elements 13 and 13*a* to obtain different patterns and/or sequence of patterns. Finally, it should be noted that the beam element 11***b* can be provided with wider flanges such as the flanges 18*a* of FIG. 6 if desired.

Although various minor modifications may be suggested by those versed in the art, it should be understood that I wish to embody within the scope of the patent granted hereon, all such modifications as reasonably and properly come within the scope of my contribution to the art.

I claim:

1. A system for covering a surface to form a wall surface selected from horizontal and vertical walls, said system comprising a plurality of beam elements, each beam element having a main face portion with two sides, a leg portion along each side terminating in a flange extending substantially parallel to the face portion, said face portion and leg portions forming a substantially U-shaped cross-section with the face portion being a bight portion extending between the parallel leg portions, each of the leg portions at a fixed distance from the flange having a pair of longitudinally extending creases to form an internal shoulder facing an inner surface of the face portion and an outer shoulder facing the flange; means for mounting the beam elements to extend parallel with a prescribed spacing between the leg portions of adjacent beam elements, said means for mounting including at least two sets of fastening elements with each fastening element having a pair of oppositely facing hooks for engaging the pair of internal shoulders of the beam element and means spacing the fastening elements of each set with the desired spacing therebetween to obtain the prescribed spacing between leg portions of adjacent beam elements; and a filler element for assembly between each pair of beam elements, each filler element having a U-shaped cross-section with a flat, planar bight portion and a pair of parallel extending legs having edges, each leg being substantially planar and having a crease spaced inward from said edge at a distance equal said fixed distance to form a single, outwardly extending catch surface, said filler element being snapped into the space between leg portions of adjacent beam elements and the catch surfaces engage the external shoulders of the leg portions to hold the filler element in place as the edges of the legs of said filler element engage the flanges of the beams.

2. A system according to claim 1, wherein the flanges are narrow flanges with edges and the prescribed spacing causes a gap to extend between edges of flanges of adjacent beam elements beneath the filler element.

3. A system according to claim 1, wherein the flanges are wide flanges of a width so that flanges of adjacent beam elements overlap to form a closed reveal beneath the filler element.

4. A system according to claim 1, wherein each of the legs of the filler elements has a short distance between the flat, planar bight portion and the crease forming the catch surface so that the bight portion is a recessed surface relative to the face portions of the adjacent beam elements.

5. A system according to claim 1, wherein the legs of each of the filler elements between the flat, planar bight portion and the catch surface has a width equal to a width between the outer shoulder and the face portion of the beam so that the flat, planar bight portion lies flush with the face portions of the adjacent beam elements when the filler element is received with the catch surfaces engaged on the external shoulders.

6. A system according to claim 1, wherein each of the beam elements has a face portion having a longitudinal depression with a rectangular cross section being formed by a flat base and a pair of side walls, said depression extending along the center of the face portion to subdivide the face portion into two elevated surfaces extending in one plane and separated by said depression.

7. A system according to claim 6, wherein each of the fastening elements has a substantially straight edge portion extending between the two hooks and each of the beam elements between the internal shoulder and the face portion have a leg portion equal to the width of the hood portion and a depth of the depression so that the base of the depression on the face portion rests substantially on said edge of the fastening element.

8. A beam element for use with clips to form a wall system having a plurality of spaced apart parallel beam elements, said beam element having a substantially U-shaped cross-section with a face portion forming a bight of the U-shaped cross-section with two leg portions extending therefrom, said face portion having a depression with a rectangular cross section being formed by a flat base and side walls, said depression extending longitudinally along the center of the face portion to subdivide the face portion into spaced apart parallel portions extending in the same plane, each of said leg portions terminating in a flange and having a pair of longitudinally extending creases to form an inner shoulder facing an inner surface of the face portion and an outer shoulder facing the flange with the inner shoulder being adapted for engaging surfaces of hooks of a clip for securing the beam element in the wall system, said flanges being narrow and having an edge extending just slightly beyond the outer shoulder of the leg portion to provide a gap between the edges of adjacent beam elements when assembled in the wall system.

* * * * *